US011123847B2

(12) United States Patent
Huang

(10) Patent No.: US 11,123,847 B2
(45) Date of Patent: Sep. 21, 2021

(54) TOOL ASSEMBLY APPARATUS

(71) Applicant: Shi-Lung Huang, Changhua (TW)

(72) Inventor: Shi-Lung Huang, Changhua (TW)

( * ) Notice: Subject to any disclaimer, the term of this patent is extended or adjusted under 35 U.S.C. 154(b) by 345 days.

(21) Appl. No.: 16/378,382

(22) Filed: Apr. 8, 2019

(65) Prior Publication Data

US 2020/0316758 A1 Oct. 8, 2020

(51) Int. Cl.
*B25B 23/00* (2006.01)
*B25B 23/12* (2006.01)
*B25B 21/00* (2006.01)

(52) U.S. Cl.
CPC ..... *B25B 23/0035* (2013.01); *B25B 23/12* (2013.01); *B25B 21/00* (2013.01)

(58) Field of Classification Search
CPC ..... B25B 23/0035; B25B 23/12; B25B 21/00; B25B 15/00; B25B 15/001; B25B 17/00
See application file for complete search history.

(56) References Cited

U.S. PATENT DOCUMENTS 6,418,821 B1 * 7/2002 Yamakawa ..... B25B 13/06 81/437
8,196,495 B2 * 6/2012 Chen ..... B25B 23/0035 81/437
9,463,558 B2 * 10/2016 Yang ..... B25B 23/0035
9,981,366 B2 * 5/2018 Todd ..... B25B 13/06
10,328,554 B2 * 6/2019 Todd ..... B25B 23/0035
2017/0348832 A1 * 12/2017 Yang ..... B25B 23/0035
2018/0071899 A1 * 3/2018 Peters ..... B25B 23/12
2019/0118357 A1 * 4/2019 Huang ..... B25B 23/0035
2019/0329387 A1 * 10/2019 Chen ..... B25B 23/0028

* cited by examiner

*Primary Examiner* — David B. Thomas
(74) *Attorney, Agent, or Firm* — Che-Yang Chen; Law Office of Michael Chen

(57) ABSTRACT

A tool assembly apparatus may comprise a sleeve, a locating ball, an elastic locating piece, and a connecting rod. The sleeve has a first end and a second end, and the first end and the second end of the sleeve respectively have an axial first engaging hole and an axial second engaging hole which are communicated to axially penetrate through the sleeve. The inner diameter of the second engaging hole is smaller than the first engaging hole, and the sleeve has a radial through hole penetrating through an outer periphery thereof to communicate with the second engaging hole. The elastic locating piece has a ring body which comprises a locating hole and a cutting portion thereon. The connecting rod comprises a bearing section and a driving section, and a middle section is connected therebetween. The driving section has a locating recess formed thereon.

4 Claims, 5 Drawing Sheets

TOOL ASSEMBLY APPARATUS

FIELD OF THE INVENTION

The present invention relates to a tool and more particularly to a tool assembly apparatus that is easy to operate.

BACKGROUND OF THE INVENTION

Referring to FIG. 5, a conventional tool assembly apparatus comprises a connecting rod (60) and a sleeve (70). The connecting rod (60) has a connecting section (61) and a driving section (62), and a blocking edge (63) formed between the connecting section (61) and the driving section (62) has a larger outer diameter than the connecting section (61) and the driving section (62). The driving section (62) comprises an annular groove (64) on an outer periphery thereof. A screw hole (71) penetrates through the sleeve (70), and a locating bolt (72) having a spring disposed thereon is adapted to engage with the screw hole (71). When the connecting rod (60) is connected to the sleeve (70) through the driving section (62), the locating bolt (72) is engaged with the annular groove (64) so as to secure the connection between the sleeve (70) and the connecting rod (60).

However, the conventional tool assembly apparatus has following disadvantages: (i) the sleeve (70) needs to have a screw hole (71) to engage with the locating bolt (72), and in order to make sure that the locating bolt (72) can be fully positioned, an outer wall of the sleeve (70) has to be made thicker, which will increase the manufacturing cost and the weight of the tool assembly apparatus; (ii) the screw thread of the screw hole (71) has its angle, and the locating bolt (72) may be deflected when locked into the screw hole (71) so as to increase difficulty when operating; and (iii) it is also inconvenient when the assembly has to be accomplished through the screw hole (71). Therefore, there remains a need for a new and improved design for a tool assembly apparatus to overcome the problems presented above.

SUMMARY OF THE INVENTION

The present invention provides a tool assembly apparatus which comprises a sleeve, a locating ball, an elastic locating piece, and a connecting rod. The sleeve has a first end and a second end, and the first end and the second end of the sleeve respectively have an axial first engaging hole and an axial second engaging hole which are communicated to axially penetrate through the sleeve. The inner diameter of the second engaging hole is smaller than the first engaging hole, and the length of the second engaging hole is longer than the first engaging hole. The sleeve is adapted to be used through the first end or the second end depending on actual use. The sleeve has a radial through hole penetrating through an outer periphery thereof to communicate with the second engaging hole, and the inner diameter of the through hole is gradually smaller toward the second engaging hole so as to enable the locating ball to be positioned therein without falling into the second engaging hole.

The elastic locating piece has a ring body which comprises a locating hole and a cutting portion thereon, and two sides of the cutting portion are configured to be pulled apart and bounced back when released so as to enable the ring body to tightly clamp on the outer periphery of the sleeve. The locating hole is aligned with the locating ball so as to create space for the locating ball, and the elastic locating piece is adapted to keep pressing the locating ball inwardly.

The connecting rod comprises a bearing section and a driving section, and a middle section is connected therebetween. The driving section has a locating recess formed thereon. The locating ball is engaged in the locating recess when the connecting rod is inserted into the second engaging hole through the driving section, so as to transmit power between the connecting rod and the sleeve.

Comparing with conventional tool assembly apparatus, the present invention is advantageous because: (i) with the design of the locating ball, an outer wall of the sleeve has no need to be made thinker, which lowers the manufacturing cost and the weight of the tool assembly apparatus; (ii) the locating ball is installed through the elastic locating piece to avoid the structural damage of the tool assembly apparatus, which also makes the sleeve simpler and faster for installation; and (iii) the sleeve can be used through both ends thereof, so that a user has no need to prepare different sizes of the sleeves for different specifications of the connecting members.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
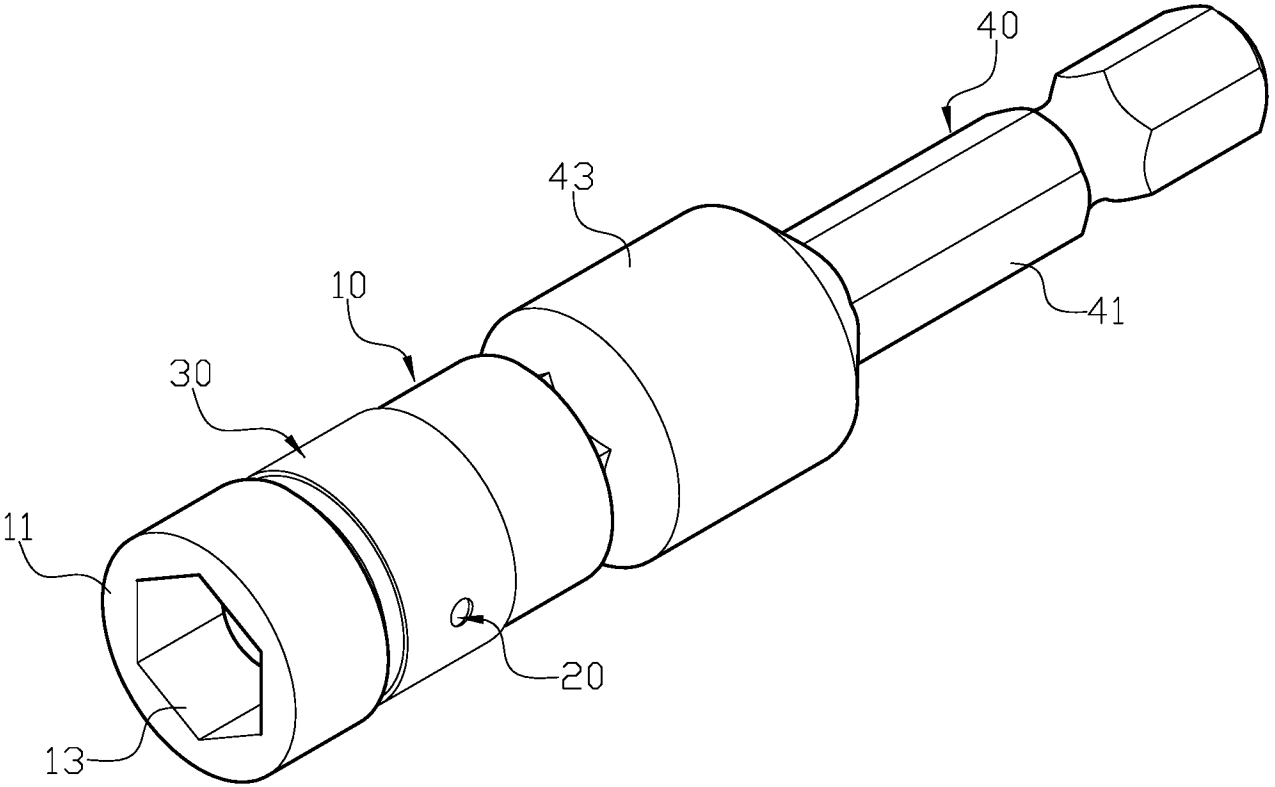
FIG. 1 is a three-dimensional assembly view of a tool assembly apparatus of the present invention.
Figure 2:
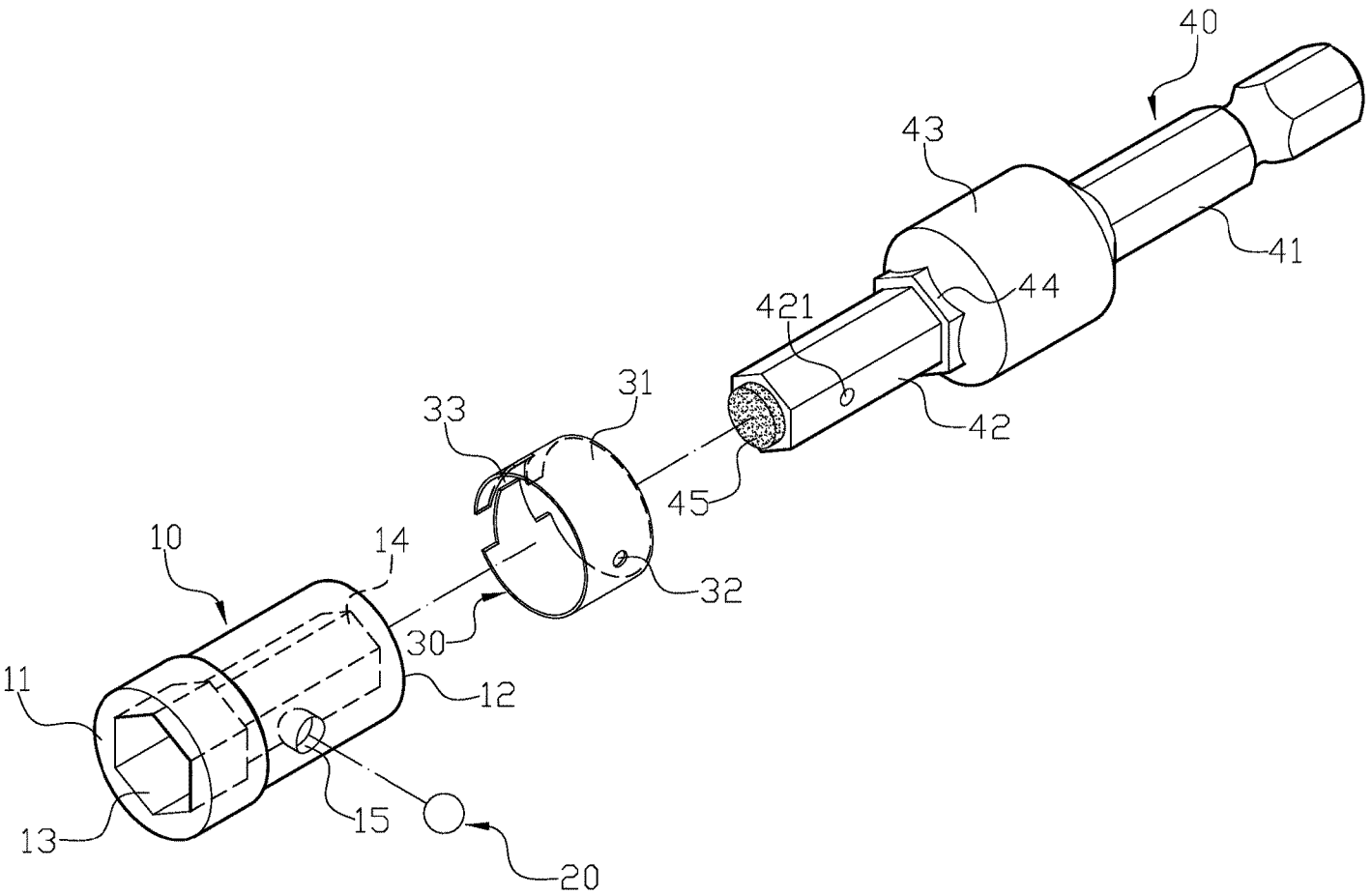
FIG. 2 is a three-dimensional exploded view of the tool assembly apparatus of the present invention.
Figure 3:
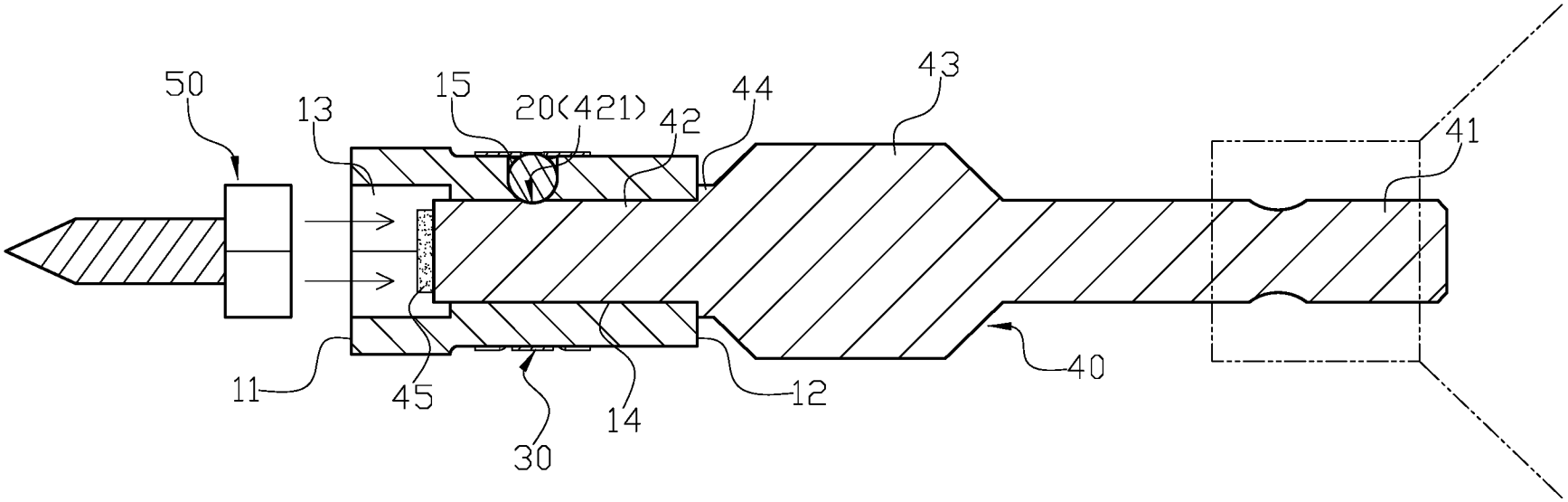
FIG. 3 is a schematic view of the tool assembly apparatus of the present invention when in use.

In order to further understand the goal, characteristics and effect of the present invention, a number of embodiments along with the drawings are illustrated as following:

Referring to FIGS. 1 and 2, the present invention provides a tool assembly apparatus which comprises a sleeve (10), a locating ball (20), an elastic locating piece (30) and a connecting rod (40). The sleeve (10) has a first end (11) and a second end (12), and the first end (11) and the second end (12) of the sleeve (10) respectively have an axial first engaging hole (13) and an axial second engaging hole (14) which are communicated to axially penetrate through the sleeve (10). The inner diameter of the second engaging hole (14) is smaller than the first engaging hole (13), and the length of the second engaging hole (14) is longer than the first engaging hole (13). The sleeve (10) is adapted to be used through the first end (11) or the second end (12) depending on actual use. The sleeve (10) has a radial through hole (15) penetrating through an outer periphery thereof to communicate with the second engaging hole (14), and the inner diameter of the through hole (15) is gradually smaller toward the second engaging hole (14) so as to enable the locating ball (20) to be positioned therein without falling into the second engaging hole (14). The elastic locating piece (30) has a ring body (31) which comprises a locating hole (32) and a cutting portion (33) thereon, and two sides of the cutting portion (33) are configured to be pulled apart and bounced back when released so as to enable the ring body (31) to tightly clamp on the outer periphery of the sleeve (10). The locating hole (32) is aligned with the locating ball (20) so as to create space for the locating ball (20), and the elastic locating piece (30) is adapted to keep pressing the locating ball (20) inwardly. The connecting rod (40) comprises a bearing section (41) and a driving section (42), and a middle section (43) is connected therebetween. The driving section (42) has a locating recess (421) formed thereon. The locating ball (20) is engaged in the locating recess (421) when the connecting rod (40) is inserted into the second engaging hole (14) through the driving section (42), so as to transmit power between the connecting rod (40) and the sleeve (10).

In one embodiment, each of the first engaging hole (13), the second engaging hole (14), the bearing section (41), and the driving section (42) has a hexagonal cross-section.

In another embodiment, an annular groove (not shown in FIGs.) is formed on the outer periphery of the sleeve (10) to tightly receive the elastic locating piece (30).

Figure 4:
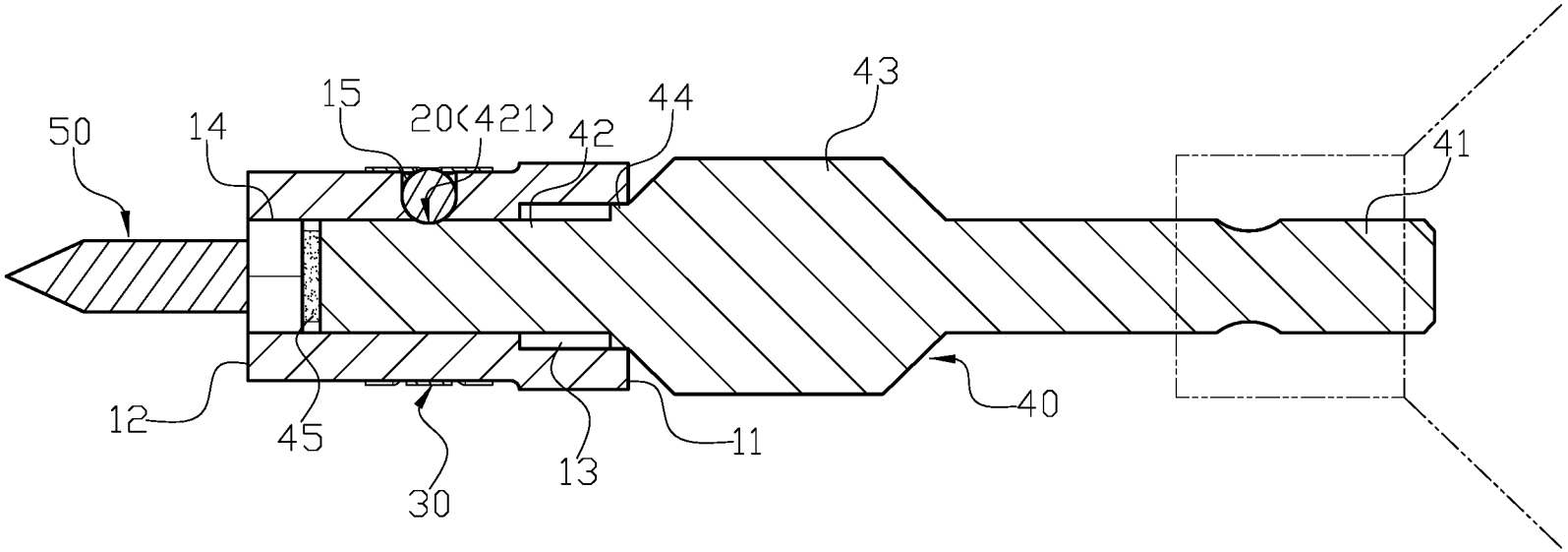
FIG. 4 is a schematic view illustrating a connecting rod is inserted into a sleeve of the tool assembly apparatus through a first end thereof for use in the present invention.
Figure 5:
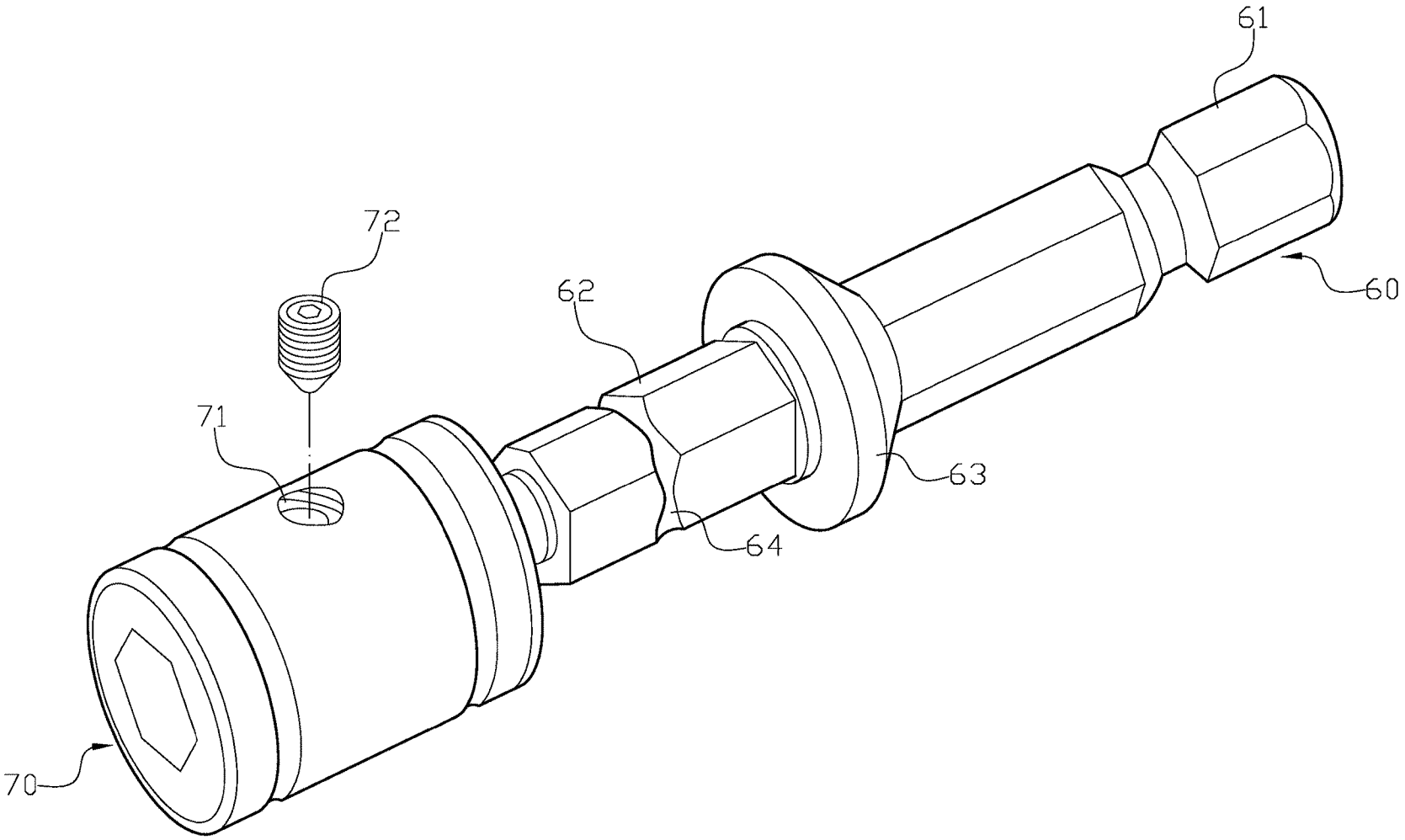
FIG.5 PRIOR ART
FIG. 5 is a prior art.

In still another embodiment, a stepped edge (44) is formed between the driving section (42) and the middle section (43), and the stepped edge (44) has a larger diameter than the driving section (42); when the connecting rod (40) is inserted into the first end (11) of the sleeve (10) through the driving section (42), the stepped edge (44) is adapted to couple with the first engaging hole (13) (as shown in FIG. 4), so as to firmly establish the connection between the sleeve (10) and the connecting rod (40).

In a further embodiment, a magnetic member (45) is mounted on an end of the driving section (42).

In actual application, the bearing section (41) is connected to a pneumatic tool or an electric tool, and depending on the specification of a connecting member (50) such as a bolt, a user can selectively put the driving section (42) of the connecting rod (40) into the second engaging hole (14) through the first end (11) or the second end (12) of the sleeve (10) (as shown in FIG. 4). Thus, the first engaging hole (13) or the second engaging hole (14) is configured to engage with the connecting member (50), and through operating the pneumatic tool or the electric tool, the connecting member (50) is adapted to be driven to have clockwise or counter-clockwise rotation. Namely, the sleeve (10) can be used through both ends thereof so as to enable the tool assembly apparatus of the present invention to engage with different tool heads for use.

Comparing with conventional tool assembly apparatus, the present invention is advantageous because: (i) with the design of the locating ball (20), an outer wall of the sleeve (10) has no need to be made thinker, which lowers the manufacturing cost and the weight of the tool assembly apparatus; (ii) the locating ball (20) is installed through the elastic locating piece (30) to avoid the structural damage of the tool assembly apparatus, which also makes the sleeve (10) simpler and faster for installation; and (iii) the sleeve (10) can be used through both ends thereof, so that a user has no need to prepare different sizes of the sleeves (10) for different specifications of the connecting members (50).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A tool assembly apparatus comprising a sleeve, a locating ball, an elastic locating piece, and a connecting rod;

wherein the sleeve has a first end and a second end, and the first end and the second end of the sleeve respectively have an axial first engaging hole and an axial second engaging hole which are communicated to axially penetrate through the sleeve; the inner diameter of the second engaging hole is smaller than the first engaging hole, and the length of the second engaging hole is longer than the first engaging hole; the sleeve is adapted to be used through the first end or the second end depending on actual use; the sleeve has a radial through hole penetrating through an outer periphery thereof to communicate with the second engaging hole, and the inner diameter of the through hole is gradually smaller toward the second engaging hole so as to enable the locating ball to be positioned therein without falling into the second engaging hole; and wherein the elastic locating piece has a ring body which comprises a locating hole and a cutting portion thereon, and two sides of the cutting portion are configured to be pulled apart and bounced back when released so as to enable the ring body to tightly clamp on the outer periphery of the sleeve; the locating hole is aligned with the locating ball so as to create space for the locating ball, and the elastic locating piece is adapted to keep pressing the locating ball inwardly; the connecting rod comprises a bearing section and a driving section, and a middle section is connected therebetween, and the driving section has a locating recess formed thereon; the locating ball is engaged in the locating recess when the connecting rod is inserted into the second engaging hole through the driving section, so as to transmit power between the connecting rod and the sleeve.

2. The tool assembly apparatus of claim 1, wherein each of the first engaging hole, the second engaging hole, the bearing section, and the driving section has a hexagonal cross-section.

3. The tool assembly apparatus of claim 1, wherein a stepped edge is formed between the driving section and the middle section, and the stepped edge has a larger diameter than the driving section.

4. The tool assembly apparatus of claim 1, wherein a magnetic member is mounted on an end of the driving section.

* * * * *